United States Patent [19]

Norden

[11] 4,366,354

[45] Dec. 28, 1982

[54] CIRCUIT BREAKER WITH IMPROVED CONTACT PUSH-OFF SPRING

[75] Inventor: Alexander R. Norden, New York, N.Y.

[73] Assignee: Federal Pacific Electric Company, Newark, N.J.

[21] Appl. No.: 220,758

[22] Filed: Dec. 29, 1980

[51] Int. Cl.[3] ..... H01H 3/32

[52] U.S. Cl. ..... 200/154; 200/153 SC; 200/73

[58] Field of Search ..... 200/154, 153 SC, 244, 200/245, 73, 74, 153 G; 337/67, 47, 46

[56] References Cited

U.S. PATENT DOCUMENTS

| | | | |
|---|---|---|---|
| 2,418,556 | 4/1947 | Miller et al. | 200/74 |
| 2,863,963 | 12/1958 | Johnson | 200/154 |
| 2,923,788 | 2/1960 | Norden | 200/74 |
| 3,581,261 | 5/1971 | De Torre et al. | 337/67 |
| 3,610,856 | 10/1971 | De Torre | 200/153 |

*Primary Examiner*—Willis Little

*Attorney, Agent, or Firm*—Ronald R. Stanley; Roy F. Hollander

[57] ABSTRACT

A circuit breaker has contacts engageable as a result of manual operation of a toggle mechanism causing the circuit breaker to close and open when the toggle is in an erect and collapsed condition, respectively. A push-off spring is used to bias a moveable contact away from a stationary contact to accelerate movement of the moveable contact during opening of the circuit breaker. Minimal manual effort is required to close the circuit breaker while providing greatly increased pressure for accelerating opening of the circuit breaker through use of a unique push-off spring which provides a first, lower, degree of resistance to closing of the contacts during the initial operation of the circuit breaker while providing a second, higher, degree of resistance to closing of the contacts after the initial operation. Manual closing of the circuit breaker is unimpeded by the second, higher, degree of resistance after the initial operation of the breaker.

10 Claims, 5 Drawing Figures

CIRCUIT BREAKER WITH IMPROVED CONTACT PUSH-OFF SPRING

BACKGROUND OF THE INVENTION

The present invention relates to manually operated circuit breakers and, more particularly, to circuit breakers having a moveable contact on a spring biased contact member manually actuated through a toggle arrangement.

Circuit breakers, providing reuseable electrical circuit protection, have gradually replaced fuses providing one time protection, in most applications throughout the United States. These circuit breakers consist of a fixed electrical contact to which one circuit conductor is connected and a moveable contact to which the other circuit conductor is connected. A handle is exteriorly provided for manual operation of the breaker between open and closed circuit conditions, corresponding to separation or engagement of the moveable contact and the stationary contact, respectively. The handle is connected to the moveable contact through a toggle arrangement such as an over-center linkage. It is imperative that the engagement of the stationary and moveable contacts occur with sufficient pressure therebetween to avoid destruction of the contact material as a result of arcing therebetween. In order to maintain firm contact between the moveable and stationary contacts when the circuit breaker is in the closed condition, the toggle mechanism maintains considerable force on the moveable contact against the stationary contact.

Circuit breakers include a mechanism for sensing overcurrent conditions when the contacts are conducting more electrical current than the breaker is rated to carry. While any one of a number of mechanisms may be incorporated within a particular circuit breaker, the mechanism often comprises a magnetic or bimetallic releasable latch which enables automatic opening of the breaker in the event that the current carried thereby exceeds a predetermined value. When the circuit breaker is to open as a result of the releasable latch functioning, it is desirable that the physical opening of the contacts occur at as rapid a rate as possible. To obtain the rapid movement of the moveable contact relative to the stationary contact, mechanical mechanisms such as springs are provided between the stationary and moveable contacts. Obviously, the opening of the circuit breaker will occur at a speed dependent upon the force of the biasing spring provided between the contacts.

It may be easily understood that the operation of this biasing or push-off spring, and the toggle mechanism for forcing the contacts against each other when the breaker is closed, may actually impede one another. Additionally, the force of any mechanism biasing the contacts apart for the purpose of providing quick opening of the circuit breaker, directly opposes the force necessary to manually operate the breaker into a closed condition. As a result, increasing the biasing pressure between the contacts normally increases the pressure required in order to move the circuit breaker handle from the open position to the closed position. Various attempts have been made at constructing a manually operated circuit breaker which provides sufficient force against the stationary contact by the moveable contact when the breaker is intended to be in the closed position, which provides adequate biasing between the contacts to enable quick opening of the breaker upon release by a latch mechanism and which enables ease of operation from the open condition to the closed condition by movement of the toggle handle. Examples of breakers which address all of these problems are illustrated in U.S. Pat. No. 3,581,261 and 3,610,856. In each case, the apparatuses disclosed in the above mentioned patents include an additional spring providing the force required to cause the breaker to open quickly upon release by the latching mechanism.

SUMMARY OF THE INVENTION

In accordance with the present invention, a manually operable circuit breaker is provided with a spring mechanism enabling quick opening of the circuit breaker upon tripping thereof while not impeding manual operation of the breaker into a closed condition. The circuit breaker of the present invention avoids the use of multiple springs to obtain spring pressure for both latching and release of a contact mechanism.

While the invention is illustrated and described in the attached specification in certain of its aspects as applied to a single pole circuit breaker of somewhat conventional construction, the invention is equally apropos to multi-pole circuit breakers such as those illustrated and described in U.S. Pat. Nos. 2,923,788 and 2,923,795.

It is thus a primary object of the present invention to provide a manually operable circuit breaker which provides increased push-off between engageable contacts while not increasing the manual force necessary to operate the circuit breaker to a closed condition.

It is a further object of the present invention to provide a circuit breaker which has an increase in force providing separation between paired contacts of the breaker through use of a single spring while not impeding manual operation of the circuit breaker.

The use of a single spring to increase push-off pressure while maintaining ease of manual operation of the breaker simplifies the assembly of the breaker as compared to circuit breakers such as those shown in U.S. Pat. Nos. 3,581,261 and 3,610,856. The design of the push-off spring for each particular breaker may be arranged to increase the rate of push-off near the toggling point of the handle of the breaker where the manual closing effort is lessened due to the toggle action. Thus, low initial forces with high push-off forces are readily achievable through use of the device of the present invention.

The foregoing and other novel features, objects and advantages are better appreciated from the following detailed description of illustrated embodiments shown in the accompanying drawings.

DETAILED DESCRIPTION OF THE PREFERRED EMBODIMENTS

Figure 1:
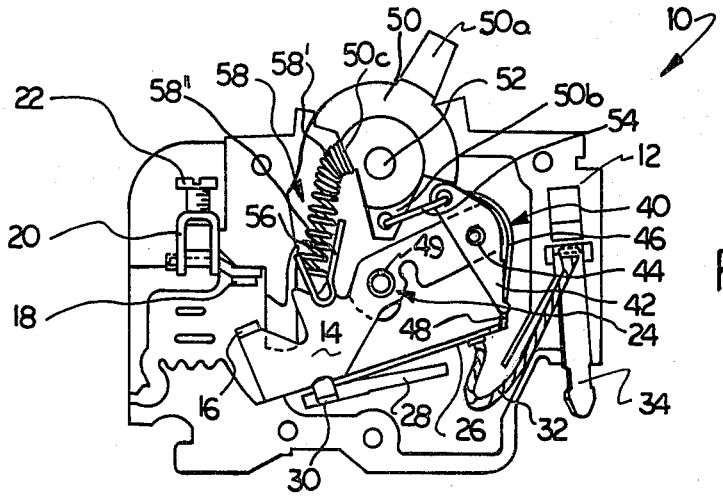
FIG. 1 is a side view of a circuit breaker with a portion of a case structure removed, shown with paired contacts open, illustrating a first embodiment of the present invention.

Referring now to FIG. 1, a circuit breaker 10 includes a case structure 12 only one-half of which is shown in the figure. Generally, the case structure is constructed in vertically divided halves which are essentially identical, and are molded from a plastic insulating material. Circuit breaker 10 as shown in FIG. 1 has the upper portion of the case structure removed therefrom to enable detailed observation of the internal components of the circuit breaker. The major component of circuit breaker 10 is an elongated moveable contact member 14. One end of the elongated member has a moveable contact 16 permanently secured thereto providing an upwardly facing, relatively flat contact surface. Supported within case structure 12 of the circuit breaker is a stationary contact 18 having a downwardly facing, relatively flat contact surface. Stationary contact 18 is electrically connected to a connector 20 to which the conductor from the circuit to be protected is secured by reason of a clamping screw 22.

Elongated contact member 14 is pivotally mounted within case structure 12 at a pivot 24 provided within appropriately molded formations within the case structure. The pivoting of elongated member 14 within the case allows moveable contact 16 to be engageable with and disengageable from stationary contact 18 at respective extremes of the rotation of the member.

For the purpose of sensing overcurrent flowing through the circuit breaker, circuit breaker 10 includes a bimetallic element 26 specifically calculated to react to a predetermined level of current flowing therethrough in a manner to be described further hereinbelow. Bimetal element 26 is secured to the elongated contact member 14 by clamping the bimetal element between the contact member and a ferromagnetic backing member 28 such as by staking or crimping as at 30. A braided electrical lead 32, preferrably of copper, is secured to the free end of bimetal element 26 as by welding. The free end of braided electrical lead 32 has a line stab 34 permanently secured thereto and arranged relative to case structure 12 to provide external access enabling connection into the electrical circuit to be protected. While connector 34 is shown as a spade or stab connection, any arrangement may be used which enables the circuit breaker to be connected into an electrical circuit with connector 34 connected to one conductor of the circuit. The arrangement of the connectors of circuit breaker 10 results in the circuit breaker having an electrical series relationship relative to the power supply and the load or apparatus to be powered by the supply.

At the end of elongated contact member 14 most remote from moveable contact 16, a trip actuator 40 is secured. Trip actuator 40 includes a body portion 42 which is pivotly secured to the elongated contact member at pivot 44 and a face or spring portion 46 which exteriorly overlies the edge of both body 42 and elongated contact member 14. The body and face of trip actuator 40 may comprise either one piece or two pieces, but in either case it is imperative that a lower edge 48 extend downwardly from trip actuator 40 in the direction of bimetal portion 26 of the elongated member. Edge 48 of trip actuator 40 is intended to engage the free edge of bimetal portion 26 and thereby form a collapsible link for use in operating circuit breaker 10 as further explained hereinbelow. Pivot 44 of the trip actuator is arranged to be made of an insulating material such that no current bypasses bimetal portion 26 of the circuit breaker through the trip actuator.

Figure 2:
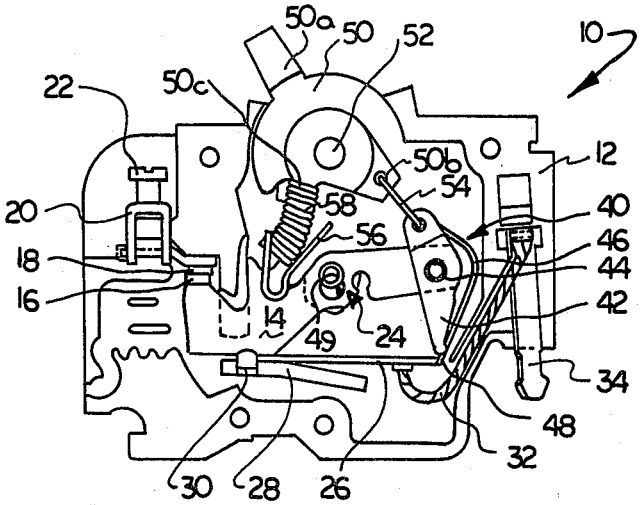
FIG. 2 is a side view of a circuit breaker with a portion of a case structure removed, shown with paired contacts closed, illustrating a first embodiment of the present invention.

Pivot 24 for the elongated contact member may either be a solid pin (not shown) or a transverse coil spring 49. When transverse coil spring 49 is used, the spring biases elongated contact member 14 clockwise about pivot 44 when circuit breaker 10 is closed, as shown in FIG. 2. In this manner, the transverse coil spring provides contact pressure between moveable contact 16 and stationary contact 18 and further permits overtravel of the contact carrying member 14 as more fully explained in U.S. Pat. No. 2,681,396. Spring 49 is supported in formed bosses molded within case structure 12.

A handle 50 has a lever **50*a* extending outwardly from case structure 12 of the circuit breaker and an arm 50*b* extending into the case structure. The handle is pivotally mounted within the case structure at pivot 52. Lever 50*a* of the handle is moveable from a first extreme, at the right as shown in FIG. 1, to a second extreme, at the left as shown in FIG. 2. Arm 50*b* of handle 50 and the upper end of trip actuator 40 are pivotally connected by a toggle link 54 which may be formed from a stiff wire threaded through appropriate apertures in the arm and the actuator. A push-off or compression spring 58 is interposed between a boss 50*c* of handle 50 and a snap lever 56 carried by elongated member 14. The compression spring biases both the elongated contact member and the handle toward their opened positions. As illustrated in FIG. 2, compression spring 58** provides a strong contact opening biasing force when the breaker is closed.

In the closed configuration of the breaker (FIG. 2), edge 48 of trip actuator 40 engages bimetal 26 and the counterclockwise spring bias applied to contact carrying member 14 by spring 58 is resisted by the handle 50, link 54 and arm **50*b* when in overcenter condition. Counterclockwise motion of handle 50 and thus the extreme of the overcenter condition is limited by the case structure 12. Spring 58, thus, provides a limited biasing force for the operation of handle 50 toward the contact opening direction, however, this bias is insufficient to open the breaker due to the counterclockwise forces developed at pivot 52 when the breaker is closed and latched, due to the force exerted by spring 49 with contacts 16 and 18** serving as a pivot.

Interrupting capacity of circuit breaker 10 is dependent on the speed at which the contacts open upon occurrence of an overload. This speed is largely dependent upon the force which compression spring 58 provides and therefore an increase in the force of spring 58 could produce faster opening. However, an increase in the pressure of compression spring 58 results in a direct increase in effort necessary to operate handle 50 from the contact open position shown in FIG. 1 to the contact closed position shown in FIG. 2.

In order to provide high push-off forces between the closed contacts while maintaining the low level of manual effort necessary to close the contacts, it has been found that compression spring 58 can be manufactured in a manner allowing the spring to display at least two different degrees of resistance. As shown in FIG. 1, this arrangement may be accomplished by winding the spring with a portion of its turns having a close pitch 58' while the balance of the spring is wound at a much more open pitch 58''. It will be readily understood that as handle 50 is manually moved from the position shown in FIG. 1 toward the position shown in FIG. 2, compression spring 58 will begin to compress the coils together. The coils of the spring with close pitch 58' will contact one another prior to those with open pitch 58'' and prior to the handle being moved completely to the left as shown in FIG. 2. During initial movement of the handle to compress spring 58, the spring displays a first, lower degree of resistance which enables ease of manual operation of the handle. When close pitch coils 58' near the top of the compression spring engage one another, the compression spring displays a second, higher degree of resistance.

The toggle comprising arm **50*b* and link 54 lock the contacts closed, under the control of bimetal 26 which acts as a releasable latch. Upon downward deflection of the bimetal as a result of heat build up due to current flow through current responsive bimetal 26, elongated contact carrying member 14 is driven counterclockwise by spring 58 as trip actuator 40 swings clockwise about pivot 44. Spring 58 is now free to accelerate the separation of contacts 16 and 18**.

As seen in FIG. 1, representing circuit breaker 10 in the open condition, toggle arm **50*b* and link 54 are in a relaxed condition. As handle 50 is moved counterclockwise, toggle link 54 approaches its erect state and the handle tends to be progressively easier to operate as the toggle approaches the fully erect condition. It is during this portion of the movement that the compression spring 58 displays the first lower degree of resistance and thus enables ease of manual operation of the breaker. Mechanical advantage is realized as the toggle approaches its erect state and thus makes movement relatively easier. During this second portion of the movement of the toggle arrangement, compression spring 58 displays its second higher degree of resistance as a result of the closely wound coils 58' of the spring engaging one another. When toggle link 54 becomes aligned or erect, no manual effort at handle 50 is needed to overcome the force of compression spring 58 or pivot spring 49. A small amount of further motion occurs, and the toggle becomes overset thus locking the breaker closed. In this overset condition of the toggle, a clockwise biasing force on trip actuator 40 develops. The stress in compression spring 58 provides a large force that is available instantly to drive moveable contact 16 open when the overcurrent latch deflects downward and releases actuator 40. The fact that the force of spring 58 drops discontinuously when contact 16** has moved halfway to its fully open position is not important since by that time the contact arm is moving at a high speed.

Greater contact opening bias can be realized with compression spring 58 of the present invention as a result of the unique design thereof. Further, additional benefit is derived in that less manual effort is necessary to assemble the breaker in accordance with the present invention in that no additional springs are necessary in the assembled breaker. The manual effort needed for closing the circuit breaker, even in the case of multiple pole circuit breakers with one compression spring 58 per pole, remains quite reasonable.

Figure 3:
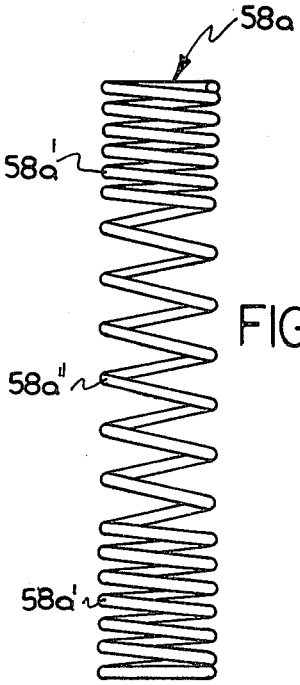
FIGS. 3 through 5 illustrate alternate embodiments of a push-off spring used in the circuit breaker shown in FIGS. 1 and 2 in accordance with the present invention.
Figure 4:
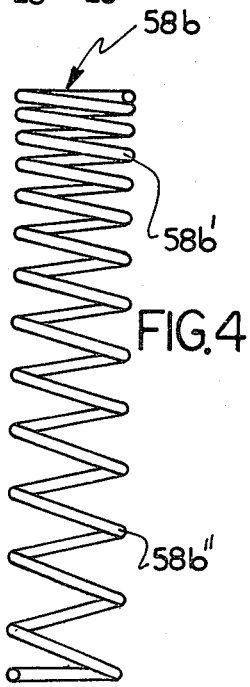
Figure 5:
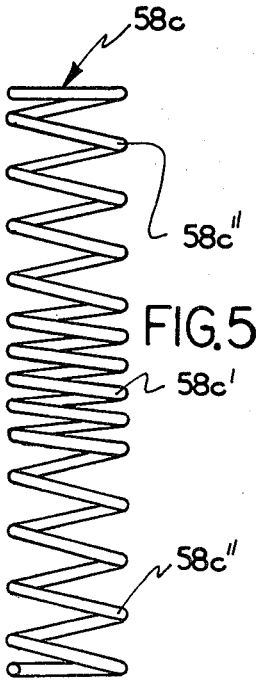

The location of, and number of, closely wound portions of the spring is not limited to that shown in FIG. 1. In this regard, a closely wound portion **58*a'* of the compression spring may occur at both ends of compression spring 58*a* as noted in FIG. 3 with openly wound portion 58*a''* therebetween. Still further, it may be desirable to have openly wound portions 58*c''* of compression spring 58*c* occur at both ends of the spring while closely wound portion 58*c'* occurs at the midsection as shown in FIG. 5 and still further, compression spring 58*b* may be wound with a continuously variable pitch (as shown in FIG. 4**) so that, as the successive turns come into contact with each other, the spring displays a continuously variable spring rate.

Modifications, changes and improvements to the preferred forms of the invention herein disclosed, described and illustrated may occur to those skilled in the art who come to understand the principles and precepts thereof. Accordingly, the scope of the invention should not be limited to the particular embodiments set forth herein, but rather should be limited only by the advance by which the invention has promoted the art.

What is claimed is:

1. A manually operable circuit breaker having an elongated movable contact member supported between its ends on a contact member pivot, said elongated movable contact member having a movable contact at one end, a stationary contact engageable by and disengageable from said movable contact when the circuit breaker is in a closed and open condition, respectively, said movable contact member having an actuator carrier by an actuator pivot at the end of the movable contact member remote from said movable contact and supporting an overcurrent releaseable latch normally restraining said actuator, a toggle including a pivoted handle and a link connected to said handle, said toggle being operable from a collapsed condition into an erect condition for operating said actuator and thereby operating said circuit breaker into the closed condition, a push-off spring biasing said circuit breaker toward said open condition, said push-off spring initially providing a first degree of resistance to closing of the contacts during operation of said circuit breaker to the closed condition, said push-off spring providing a second degree of resistance to closing of the contacts during operation of said circuit breaker to the closed condition after the initial operation, whereby manual closing of the circuit breaker initially encounters said first degree of resistance and is unimpeded by the second degree of resistance during the initial operation of the toggle toward the erect condition from the collapsed condition and the second degree of resistance is effective to accelerate opening of the contacts upon release of said overcurrent latch.

2. The circuit breaker according to claim 1 further having a case structure of insulating material in which said elongated contact member is supported, said stationary contact is mounted and said toggle handle is pivoted.

3. The circuit breaker according to claim 1 wherein said contact member pivot is a pivot spring, said pivot spring providing pressure between said stationary and movable contacts when said circuit breaker is closed.

4. The circuit breaker according to claim 1 wherein said push-off spring is a coiled wire having at least one openly wound portion providing the first degree of resistance and at least one closely wound portion providing the second degree of resistance.

5. In a manually operable circuit breaker having an elongated contact member supported for rotation between its ends within a case structure, a movable contact secured to a first end of said elongated contact member, a stationary contact mounted within said case structure, said stationary contact engageable by and disengageable from said movable contact when the circuit breaker is closed and opened, respectively, said elongated contact member having releaseable latch means, and a toggle mechanism including a handle and a link, said link connecting the handle and the elongated member at a second end of said elongated member, said toggle mechanism operable from a collapsed condition into an erect condition thereby operating said elongated contact member to close the contacts, the improvement comprising: a push-off spring biasing the movable contact away from the stationary contact, said push-off spring providing a first degree of resistance to closing of the contacts during initial operation of the circuit breaker, said push-off spring providing a second degree of resistance to closing of the contacts during operation of the circuit breaker after the initial operation, whereby manual closing of the circuit breaker is unimpeded by said second degree of resistance of the spring during initial operation of the toggle mechanism part way toward its erect condition from its collapsed condition and the second degree of resistance of the spring is effective to accelerate the opening of the contacts upon release by said releaseable latch means.

6. The improvement according to claim 5 wherein said case structure is an insulating material, said handle of the toggle mechanism being pivotally mounted within said case structure.

7. The improvement according to claim 5 wherein said elongated contact member is supported in said case structure by a contact member pivot.

8. The improvement according to claim 7 wherein said contact member pivot is a pivot spring, said pivot spring provides pressure between said stationary and movable contacts when said circuit breaker is closed.

9. The improvement according to claim 1 further including an actuator pivotally carried on said elongated contact member at the second end, said actuator including the releaseable latch means, said toggle mechanism link connecting said handle and said actuator.

10. The improvement according to claim 5 wherein said push-off spring is a coiled wire having at least one openly wound portion providing the first degree of resistance and at least one closely wound portion providing the second degree of resistance.

* * * * *